US006047714A

United States Patent [19]

Akazawa

[11] Patent Number: 6,047,714

[45] **Date of Patent: *Apr. 11, 2000**

[54] AIR INTAKE PASSAGE CLEANING METHOD AND ITS APPARATUS

[76] Inventor: Yasumasa Akazawa, 2-8-14, Higashishinmachi, Matsubara, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,407

[22] Filed: Jan. 17, 1998

Related U.S. Application Data

[63] Continuation of application No. 09/002,414, Jan. 2, 1998, abandoned.

[51] Int. Cl.[7] ..... B08B 9/00

[52] U.S. Cl. ..... 134/22.12; 15/302; 15/304

[58] Field of Search ..... 15/302, 304; 134/22.12

[56] References Cited

U.S. PATENT DOCUMENTS

| | | | |
|---|---|---|---|
| 3,485,671 | 12/1969 | Stephens | 15/304 X |
| 5,003,998 | 4/1991 | Collett | 15/304 X |
| 5,020,188 | 6/1991 | Walton | 15/304 X |
| 5,383,973 | 1/1995 | Curry | 134/22.12 X |
| 5,383,975 | 1/1995 | Faxon | 15/304 X |
| 5,438,729 | 8/1995 | Powell | 15/304 |
| 5,551,458 | 9/1996 | Faxon | 134/22.12 |
| 5,724,701 | 3/1998 | Jones | 15/304 |

*Primary Examiner*—Chris K. Moore
*Attorney, Agent, or Firm*—Moonray Kojima

[57] ABSTRACT

The present invention provides air intake passage cleaning method and its apparatus for cleaning the air intake passage of intake and exhaust apparatus for conditioning the air in building, ship, aircraft, automobile, train, or other room, to be used in an intake and exhaust apparatus comprising a heat exchanger, and at least one blow-out port for blowing out air conditioning air exchanged in heat by the heat exchanger, comprising supplying means for supplying a cleaning solvent, together with compressed air, to the heat exchanger side from a specific blow-out port through an air intake passage, and moving means for moving cleaning and wiping elements loaded in the air intake passage toward a specific blow-out port side, and hence relates to air intake passage cleaning method and its apparatus capable of securely cleaning and removing dirt deposits in the air intake passage and heat exchanger, and obtaining sanitary environments.

6 Claims, 11 Drawing Sheets

AIR INTAKE PASSAGE CLEANING METHOD AND ITS APPARATUS

RELATED APPLICATIONS

This is a continuation in part of Ser. No. 09/002,414 filed Jan. 2, 1998, now abandoned.

BACKGROUND OF THE INVENTION

1. Field of Invention

This invention relates to an air intake passage cleaning method and apparatus.

2. Description of the Prior Art

Air intake passages may be defined as passageways used to move air to and from air conditioning units, such as for example, ducts delivering cool or hot air to different rooms. The term as used herein shall refer broadly to all types of passageways, ducts, pipes, and the like.

An air conditioner usually comprises a housing, a heat exchanger which acts as an evaporator for cooling and a condenser for heating, and passageways for delivery air to and from the heat exchanger. The heat exchanger and air passages are likely to become contaminated dirt, germs, molds, waste, etc during the heat exchange process. When the air conditioner is operated with such contamination, the outgoing environment will be degraded and deteriorated.

SUMMARY OF THE INVENTION

An object of the invention is to provide an air intake or outgo passage and heat exchanger cleaning apparatus capable of cleaning the passage and heat exchanger securely and thereby improve the environment, wherein cleaning solvent and compressed air are concurrently supplied through an air passage on a heat exchanger side from a blow out port.

Another object is to provide such an apparatus wherein the cleaning solvent and compressed air are provided at an arbitrary one of a plurality of blow out ports.

A further object is to provide the cleaning solvent and compressed air at a blow out port which is furthest from the heat exchanger.

A still further object is to provide such an apparatus wherein fluid is prevented from leaking from the passage through blow out ports other than the port whereat the cleaning solvent and compressed air are applied by blocking the other blow out ports with blocking means, thereby improving cleaning efficiency.

Another object is to provide such an apparatus wherein a cleaning and wiping element is disposed in the passage with the cleaning and wiping element being impregnated or coated with the cleaning solvent.

A yet further object is to provide such an apparatus wherein means are provided for physically moving the cleaning and wiping element within the passage so taht the cleaning and wiping element contacts the inside surface of the passage and thereby wipes the inner suface clean of any deposits.

Another object is to provide such an apparatus wherein the cleaning and wiping element is connected to a traction member used to move said element within the passage.

DETAILED DESCRIPTION OF THE PREFERRED EMBODIMENTS

Figure 1:
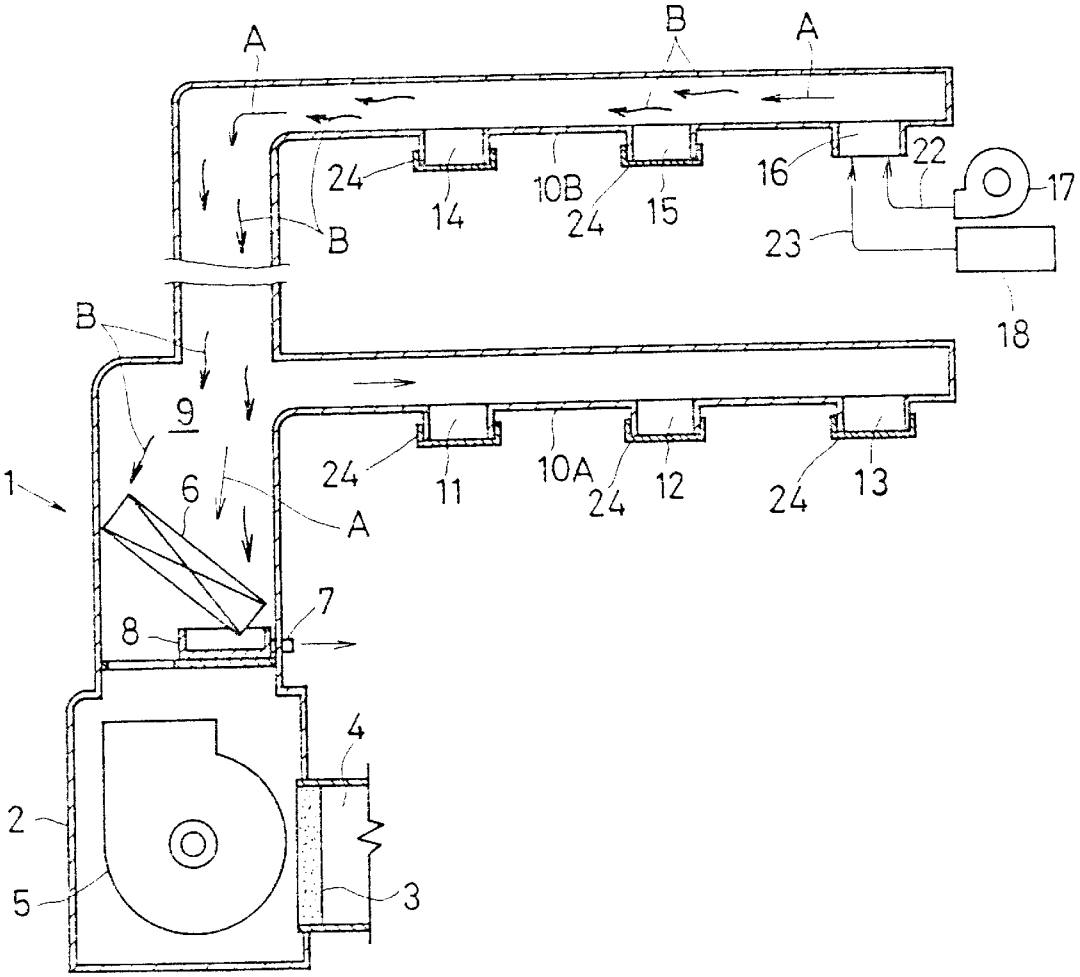
FIG. 1 is a sectional view depicting an air intake passage cleaning method and apparatus of the invention.
Figure 2:
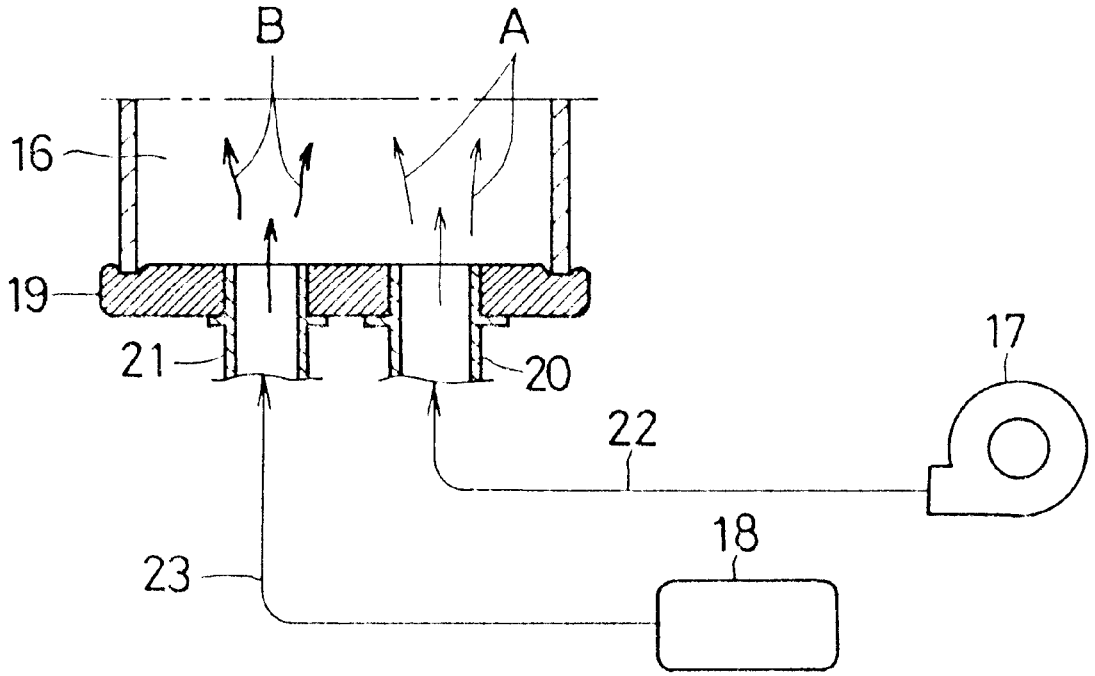
FIG. 2 is an exploded view of FIG. 1.

FIGS. 1 and 2 show an indoor air conditioner 1, such as in a central air conditioning system, comprising a housing 2, an air suction port 4, having a filter 3, at an air suction side of housing 2, and a fan 5 provided in housing 2.

Downstream of fan 5 is a heat exchanger 6 and a drain pan 8 connected to a drain pipe 7 which exits the system. The heat exchanger 6 is connected to an outdoor unit, not shown.

A downstream side chamber 9 which holds exchanger 6 is connected to ducts or passages 10A and 10B which are directed to different air conditioning areas, such as the different areas of a building. A plurality of blow out ports 11–16 are provided in ducts 10A,10B.

The air intake passage or passageways are cleaned by the cleaning apparatus of the invention which comprises a blowing fan 17, as blowing or pumping means, for supplying compressed air A, and a solvent source 18 for supplying a cleaning solvent B. The combination of compressed air A and solvent B are supplied concurrently through blow out port 16 and into duct 10B, for example. The solvent B is forcibly transmitted by the compressed air B through the duct or passageway 10B so that the solvent B comes into intimate contact with the inner surfaces of the passage 10B and the inside of chamber 9, and the heat exchanger 6.

In this embodiment, an arbitrary blow out port 16 is used. But, any one or more of the plurality of blow out ports 11–16 may be used as desired. Preferably, the blow out port to be used should be the furthest from the heat exchanger 6 so that maximum coverage is possible with a single run through of the solvent and compressed air. Port 16, to which the compressed air A and solvent B are supplied, is provided with a removable seal member 19 (see FIG. 2) and two joint pipes 2 and 21 disposed in the seal member 19 and connected respectively to compressed air pump 17 and solvent supply pump and source 18.

The cleaning solvent B may be a liquid detergent; a foamy (e.g. mousse) detergent (water, phosphoric acid, Softanol 70, propylene glycol monomethyl ether MFG, and others properly blended); cleaning water; or soap water, which may be used alone or in combination with fluids that have other functions, such as an aromatic scent, medicine, deodorant, bactericide, fungicide, etc.

The solvent source 18 may be of a filled container type for discharging the solvent under pressure of a sealed gas, or a pump, or the like may be used in addition for pumping out the solvent by force of a pumping pressure if the force supplied by the compressed air pump 17 is not sufficient.

Moreover, when supplying compressed air A and cleaning solvent B through a specific blow out port, e.g. port 16, a removably or detachable blocking member 14 is provide to block or otherwise air and/or fluid tightly cover the other blow out ports 11–15. The blocking member 24 may be a lid, a plug, a sheet, a tape, a packing material, or other members, and be suitable to air or fluid tightly fit the structure of the blow out port.

The air intake or outgo passage or passage way is cleaned by the invention in the following manner. First, the air conditioner fan 5 is stopped. Then, the blow out ports to which the compressed air pump 17 and solvent source 18 are not connected are closed using blocking members 24.

Then, as shown in FIGS. 1 and 2, seal member 19 is disposed on the specific blow out port being used to supply the compressed air a and solvent B, which in this case is port 16. Then, the pump 17 and source 17 are connected to the intake openings 20 and 21 respectively, and compressed air A and solvent B are supplied therethrough and into the interior of passageway 10B, and then through chamber 9 and through the heat exchanger 6, all as indicated by the arrows in FIG. 1.

That is, the cleaning solvent B and compressed air A are supplied to travel in a direction which is opposite the normal direction of flow of the air conditioning. In this case, since the ducts 10B and 10A communicate with each other, the cleaning solvent B and compressed air A are also supplied to duct 10A. The solvent is forcible and intimately placed in contact with the contamination deposited on the inner surface of the ducts 10A,10B, the chamber 9 and the surfaces of heat exchanger 6 so as to cause the deposits to loosen and be moved with the solvent B, and then be caused to flow into the drain pan 8 and then out of the system through outflow pipe 7.

In particular, when, for example, foamy cleaning solvent b is sued, the foamy cleaning fluid B spreads throughout the whole area of the inner surface of the ducts 10B,10A, and surfaces of the heat exchanger 6 by force of the compressed air A. Thus, a high degree of cleaning efficiency is attained and maintained. The solvent B, however, is not limited to the foamy type.

After supplying cleaning solvent B and compressed air A through blow out port 16 of duct 10B, similarly, the cleaning solvent B and compressed air A maybe supplied through blow out port 13 of duct 10A using the same pump 17 and source 18.

Figure 3:
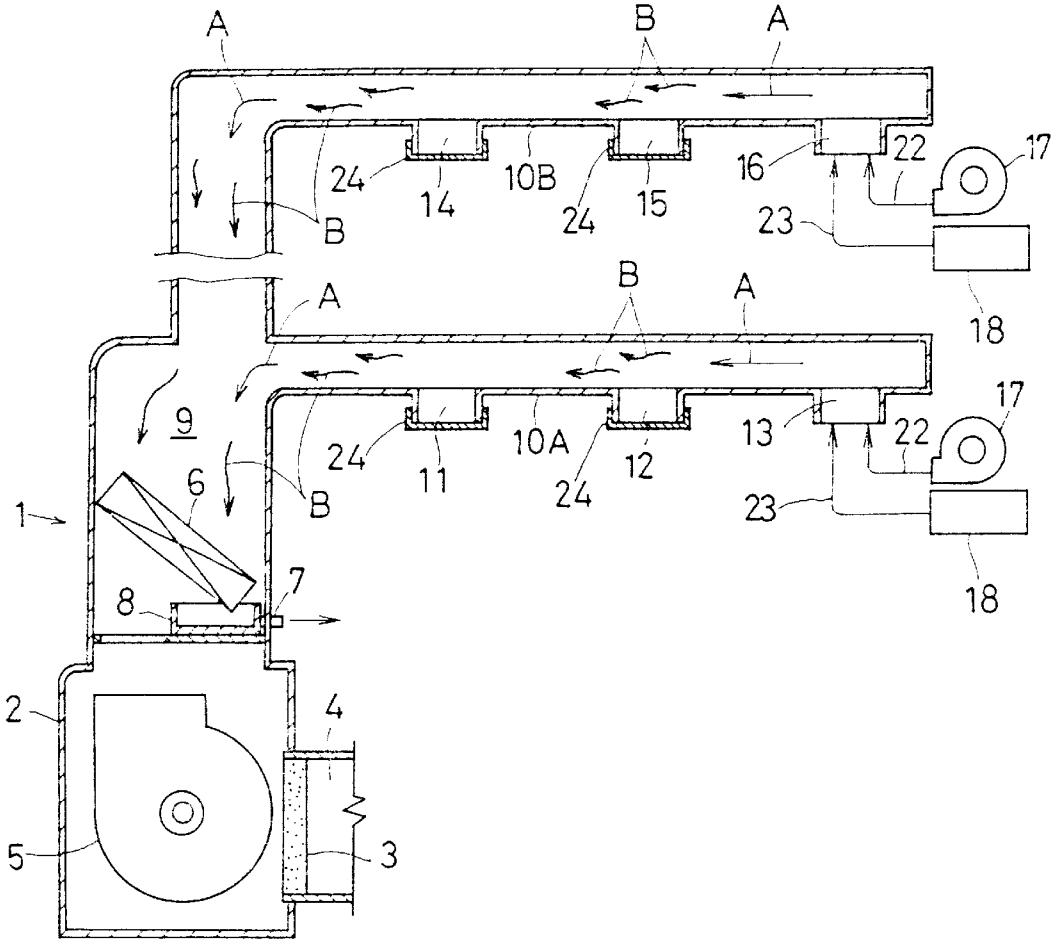
FIG. 3 is a sectional view depicting another embodiment of the invention.

In a second embodiment shown in FIG. 3, two different sources 18 of cleaning fluid B may be used together with two different pumps or fans supplying compressed air A, with one set connected to port 16 and the other set connected to port 13, as depicted. By using two sets to concurrently supply the air and solvent to both ducts 10A and 10B, cleaning efficiency is enhanced and cleaning time is shortened.

After cleaning the inside of ducts 10A,10B, with the combined use of compressed A and solvent B, the respective ducts may then be dried by supplying only compressed air A to the respective ducts using blowing fan or pumps 17.

Thus, advantageously, the ducts 10A and 10B, chamber 9, and heat exchanger 6 may be cleaned efficiently, reliably, securely and without outside contamination. Also, offensive odors, or the like, are eliminated from the air conditioning system and the indoor environment supplied by the system is enhanced in quality. Moreover, since any one or more of the blow out ports 11–16 can be used to supply the compressed air A and solvent B, cleaning operation is flexible and convenient. Also, since the cleaning solvent B can be supplied to the furthest blow out port from the heat exchanger, even for a long duct, the entire length of the duct, chamber and heat exchanger can be cleaned in one operation with easy, reliability and flexibility. Furthermore, advantageously, since the blow out ports which are not used to supply the compressed air and solvent are blocked with blocking members 24, cleaning fluid or solvent is prevented from flowing out of the ports and further compressed air is also prevented from escaping through the other ports. Accordingly, all of the fluid and compressed air are used in the cleaning operation in an efficient and reliable manner.

The term "blow out port" is also used to mean a ventilation outlet or inlet.

Figure 4:
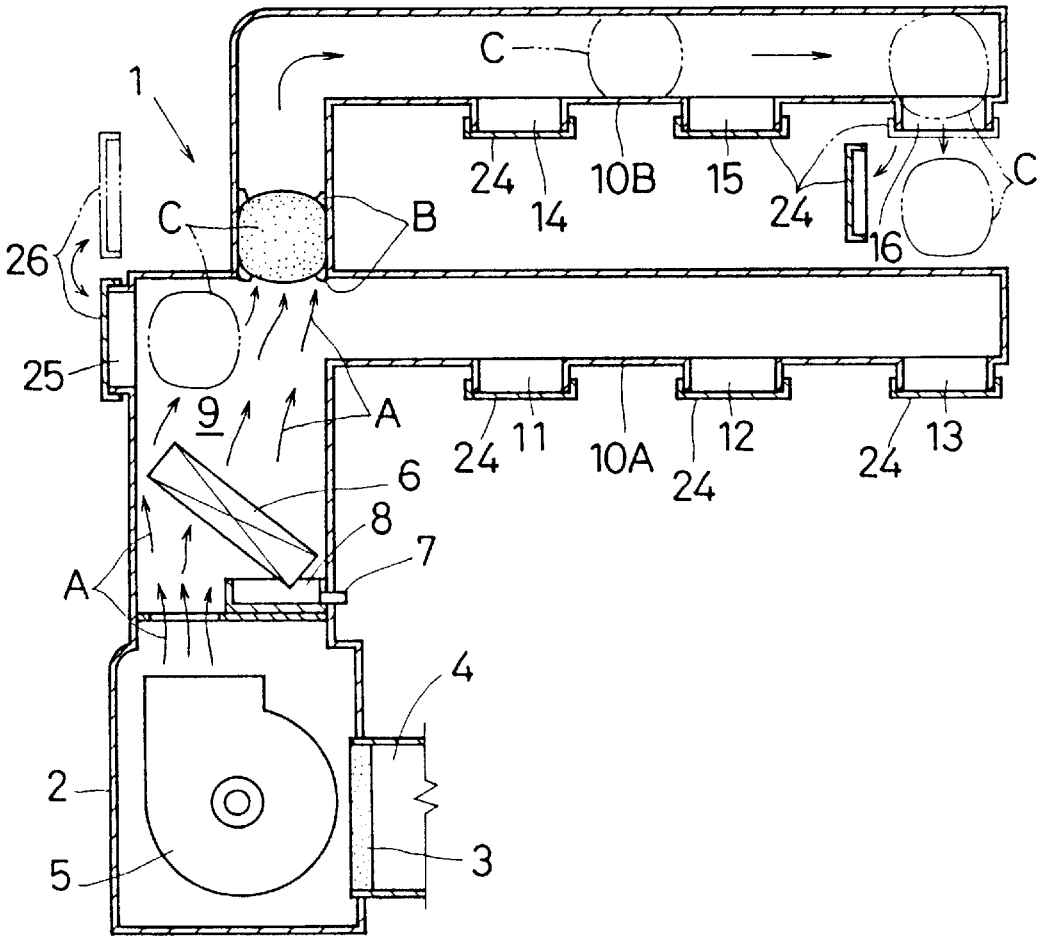
FIG. 4 is a sectional view depicting another embodiment of the invention.

A third embodiment is shown in FIG. 4 and comprises cleaning and wiping elements C, which are impregnated or otherwise coated or has contained therein, with cleaning solvent B and are disposed inside of ducts 10A and 10B and chamber 9. Fan 5 supplies air A in the direction shown by arrows to move the elements C toward a specific blow out port, for example, in this embodiment, port 16.

The cleaning and wiping elements C comprise flexible, elastic or resilient members, such as natural or artificial sponge, and are formed in a size and shape suitable to abut against and be in contact with the inner wall of ducts 10A,10B, and to air and fluid tightly contact almost the entire inner peripheral surface thereof. The cleaning and wiping elements may also comprise brushes having multiple bristles, non-woven cloth made of fibers, or cotton like mesh made of entangled wire material. The elements are impregnated, coated or otherwise filled with or saturated with the cleaning solvent. Thus, when moved axially in the duct with the element C surfaces in contact with the inner surfaces of the duct, any unwanted deposits thereon will be loosened and then caused to be removed from the inner surface. The loosened material will then be held by the element C with some being left inside the duct. In that case, by reversed flow of air the accumulated fluid and loosened material will be caused to flow to drain pan 8 and out of the system through pipe 7.

The cleaning operation is as follows. Fan 5 is first stopped. Then, all of the blow out ports 11–15 are plugged with blocking members 24 to close the respective ports, except port 16, which is to be used for the exiting of the elements C. Blocking member 26 used to close entrance port 25 is removed. Cleaning and wiping elements C, in any desired quantity, such as one as shown or more if desired, are inserted into chamber 9 through input port 25. The cleaning and wiping element C is impregnated with cleaning fluid B. The entrance 25 is then closed with blocking member 26 to be air and fluid tight. Then, fan 5 is turned ON, and the transfer pressure of air A caused by fan 5 causes element C to move from chamber 9 into duct 10B, since port 16 is open and all other ports are closed. Waste material, such as dirt, etc, deposited on the inner surfaces of the duct 10A is quickly and effectively removed and cleaned by the synergistic action of the cleaning solvent B and physical contact and movement of element C againt the inner surfaces of the duct 10B. The element C is caused to move down the duct 10B from left to right and eventually out through blow out port 16. This process can be repeated a desired number of times using the same or different elements C. If the same element C is to be re-used, first the elements having waste material thereon will have to be cleaned, and the waste material removed therefrom. This is done separately using for example a container of cleaner fluid in which the elements C are washed and rinsed. In this manner, the chamber 9 and ducts 10A, and 10B are efficiently, reliably and effectively cleaned.

The cleaning solvent B and elements C are discharged usually through blow out port 16 and are recovered. Then, the elements C are washed, for example in water, detergent or other cleaning fluid, and recycled for repeated usage. It is possible to clean the heat exchanger 6 by exposing same to the cleaning solvent B while supplying solvent B to the duct 10B. It is also possible to clean the inside of chamber 9 and duct 10B by dismounting first the heat exchanger 6.

In a similar manner duct 10A may be cleaned by opening blow out port 13 and closing the other blow out ports. As with the prior embodiment, both ducts 10A and 10B maybe cleaned simultaneously by opening both ports 13 and 16 and closing the remaining ports. In this manner, cleaning time is shortened and efficiency is improved.

A protective member, not shown, such as a cover or sheet, can be be placed beneath or around the open blow out port to collect the waste material and fluid leakage.

Advantageously, since the cleaning and wiping elements C are moved through ducts 10A,10B by action of the air pressure, the accumulated dirt, waste and other material deposits, can be securely, effectively, and reliably removed and the inside surfaces thereof be cleaned. Also, air conditioning flowing therethrough after the cleaning will be environmentally sound. Moreover, when the two ports 13 and 16 are opened and other ports closed, the two ducts 10A, and 10B are cleaned simultaneously. Thus, efficiency is increased and work time is shortened, and cost is reduced.

Figure 5:
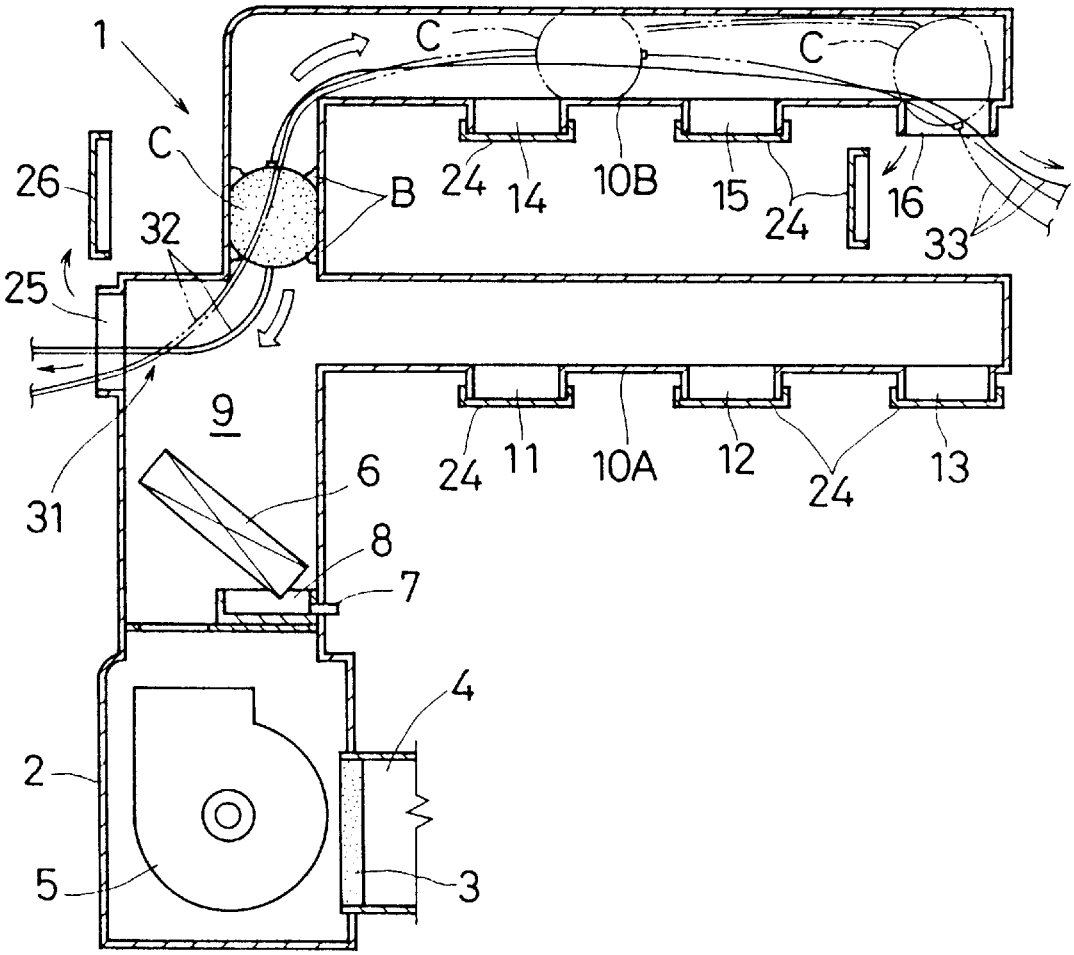
FIG. 5 is a sectional view depicting a further embodiment of the invention.

A fourth embodiment is shown in FIG. 5, wherein the cleaning and wiping elements are interconnected with traction member 31 comprising a left traction member 32 and a right traction member 33, all of which can be a single member or separate members. The traction member can be a rope, a wire, a cord, a strap, etc. The member 13 can be attached to elements C by being attached to the outside surfaces, or throught the inside center portion.

Cleaning and waste deposit removal is accomplished as follows. First, traction member 33, which is of suitable length sufficient to be pulled through port 6, which is opened and with the other ports preferably closed, and through entrance 25 having blocking member 26 removed, so that the cleaning and wiping element(s) C is pulled through the entrance 25, through chamber 9, and then through the inside of duct 10B and then exited through port 16. The elements can be pulled in either the right direction by pulling traction member 33 or the left direction by pulling traction member 32, or alternating in both directions. The elements are first impregated with cleaning solvent as in the prior embodiments. The rubbing of the elements C againt the inner surfaces of duct 10B causes the deposits be first be soaked by the solvent B and release and removal thereof. The solvent can be supplied separately into the duct. Also, the traction members 32 and 33 can be moved by a mechanical traction mechanism, such as a winch. In a similar manner, the elements C and traction members 31 can be used to clean duct 10A.

Figure 6:
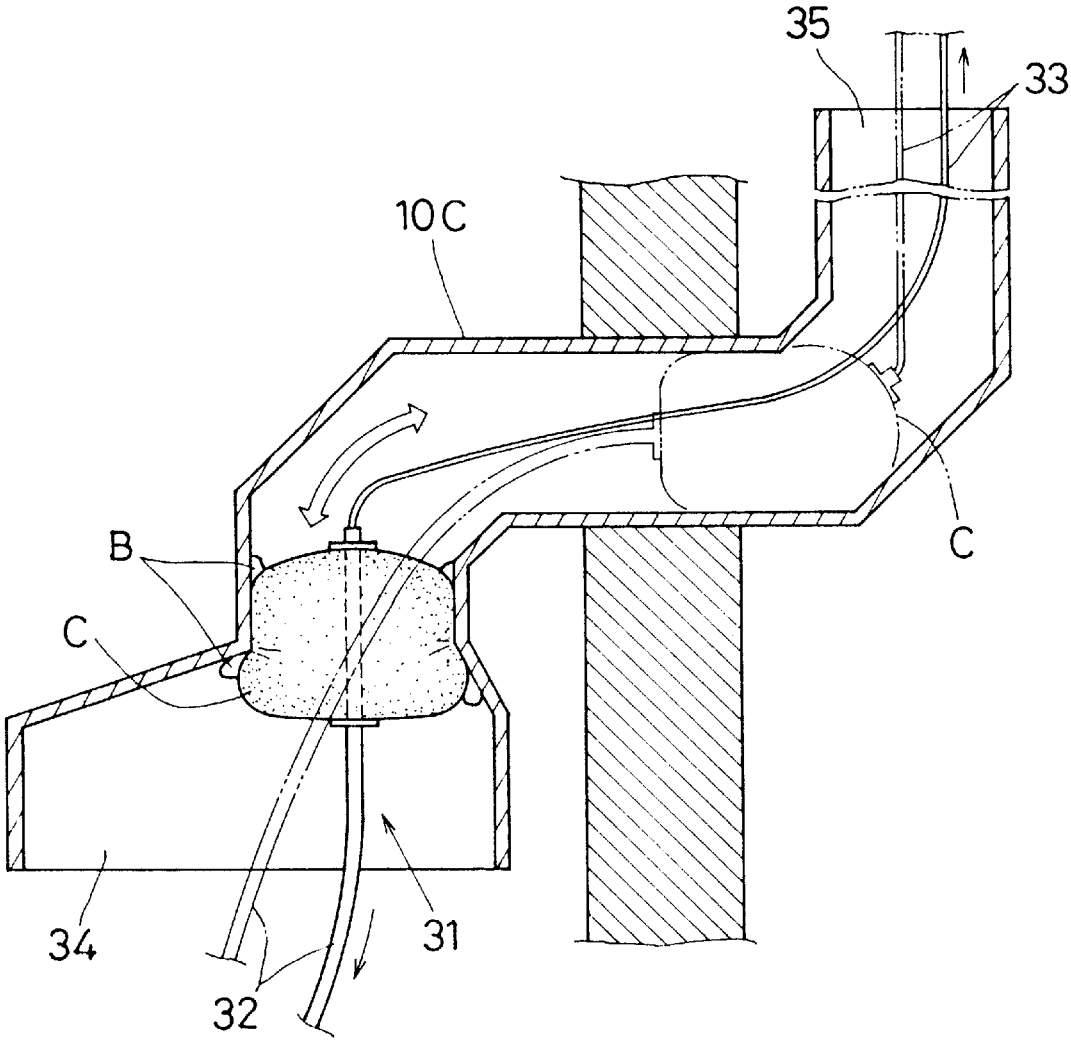
FIG. 6 is a sectional view depicting a duct cleaning method.

The same type of arrangement comprising cleaning and wiping element(s) C and traction member 31 may be used to clean deposits inside an ordinary passageway or duct, such as a duct from a kitchen. As shown in FIG. 6, the element C connected to traction member 31 is disposed inside duct 10C and traction member 33 is used to pull element C through duct 10C and clean the inside thereof. In this embodiment, rather than the traction member 33 being take through a blow out port, such as 16 or 13, in FIG. 5, the duct 10C is open at both ends.

In the FIGS. 5 and 6 situations, air pressure can be used to flush out the released and removed waste deposits caused by rubbing of the element(s) C thereagainst when the element(s) C is pulled by traction members 32 and/or 33. Also, a separate solvent B flow can be used.

Figure 7:
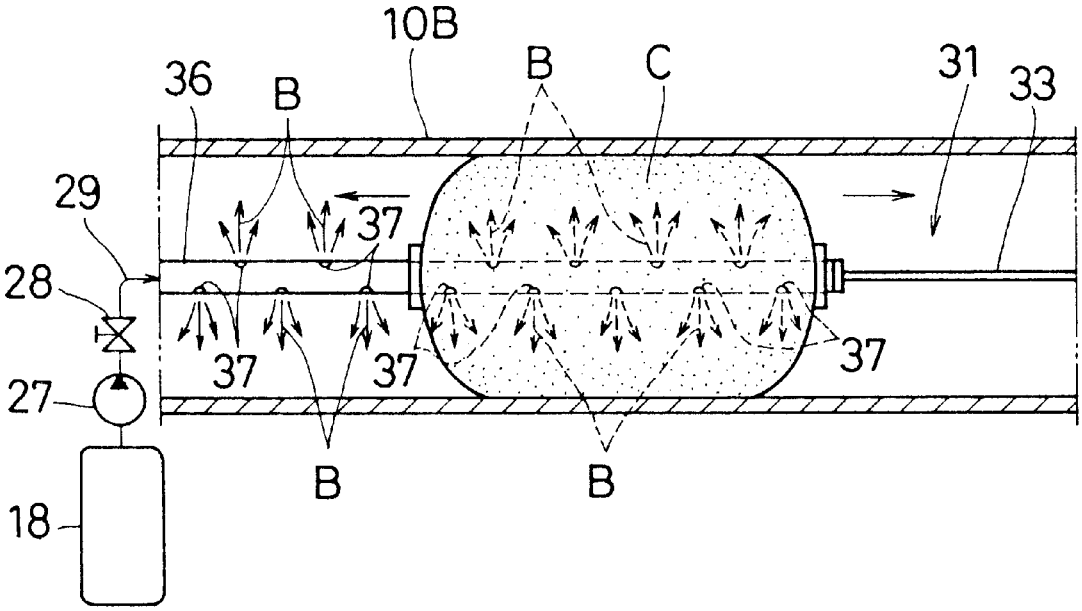
FIG. 7 is a sectional view depicting a still further embodiment of the invention.
Figure 8:
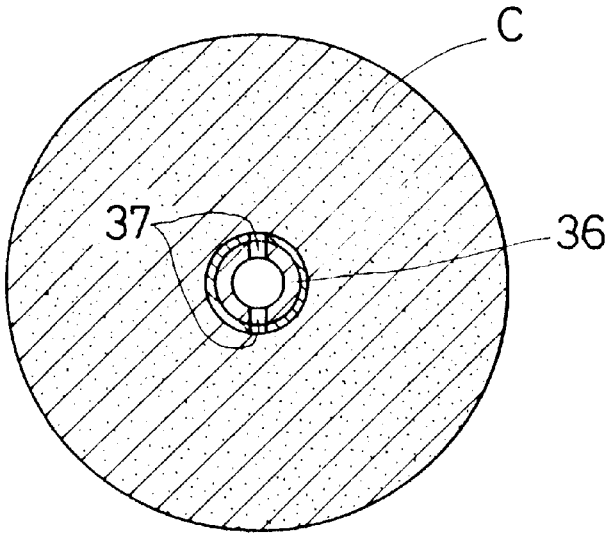
FIG. 8 is a sectional view depicting a mounted state of the cleaning and wiping elements and traction pipes.

A fifth embodiment is shown in FIGS. 7 and 8 and is designed to remove and clean waste deposit from passageway inner surfaces while blowing cleaning fluid B into the ducts 10A,10B. In this embodiment, use is made of the traction member 33 located at the right, but with the traction member 33 connected to a pipe 36 which has attached thereto element C. (See FIG. 8) The pipe 36 has a plurality of holes in the walls thereof so that solvent or cleaning fluid pumped therein will be discharged through the holes and into the element(s) C and also inside duct 10B, as shown. Pipe 36, which has the holes 37 therein is connected to feed line 29, pump 28, and valve 27, to source 18 of cleaning solvent B, as shown. The holes 37 are located both within the element C and outside of element C so that cleaning fluid B will be directed outward from pipe 36 both into the element C and into the inside of duct 10B.

The cleaning operation is as follows. Traction member 33, pipe 36 and element C are inserted into duct 10B. Cleaning solvent B, stored in source 18, is supplied through valve 27, pump 28 and feed pipe 29, into pipe 36 under pressure. The solvent B is then discharged through the holes 37 in pipe 36 to spray the inner surfaces of duct 10B and into the elastic element C to thereby impregnate element c with solvent B. Then, using human hand power or mechanical means, traction member 33 is pulled to the right, and element C is caused to rub against the inner surface of duct 10B, and cause release and removal of waste deposited thereon, with the solvent B assisting in the release and removal.

Advantageously, in this embodiment, the element C is pulled through the duct as in the prior embodiment, so that physical force is applied, but in this embodiment, there is the added advantage that a separate supply of cleaning solvent B is used by supplying such solvent B through holes in a pipe connected to the element and also through holes in the pipe exposed to the inside surface of the duct. Thus, an efficient, reliable and effective cleaning of the passageways has been achieved by the invention.

Figure 9:
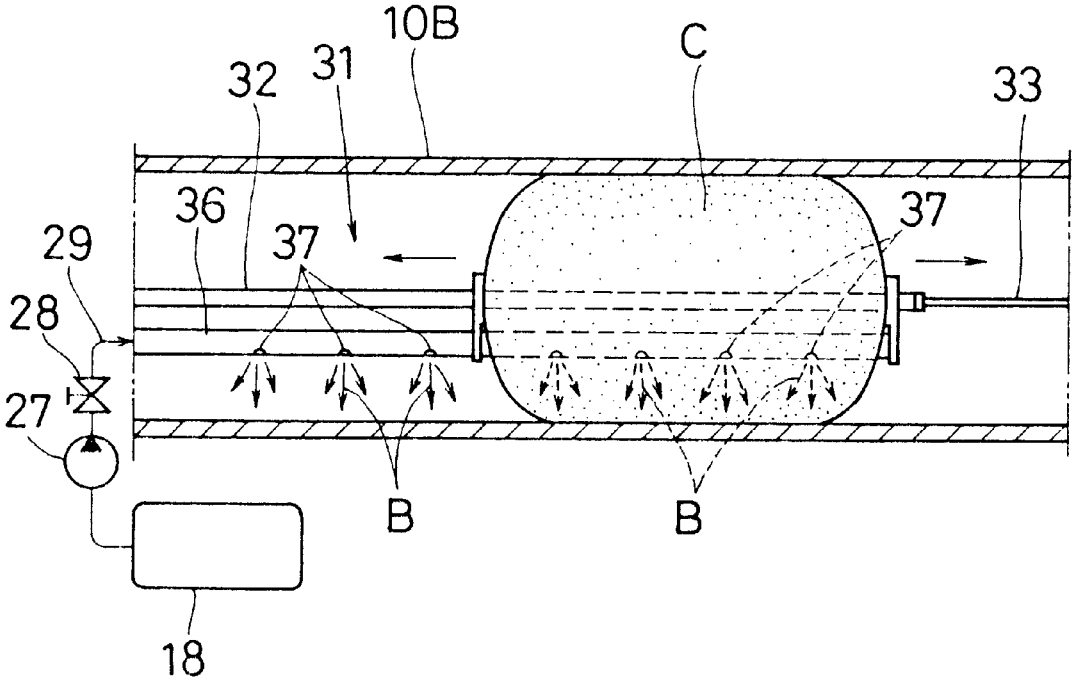
FIG. 9 is a sectional view depicting a cleaning method using the traction wires and traction pipes.
Figure 10:
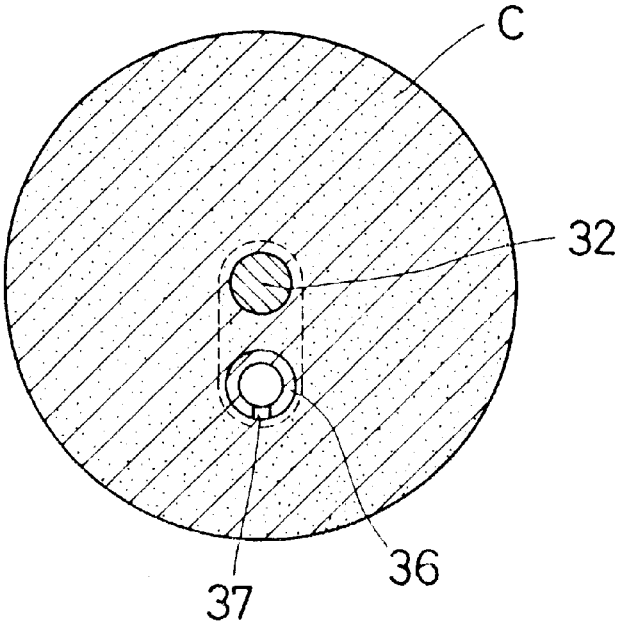
FIG. 10 is a sectional view depicting the mounted state of the traction wires and traction pipes.

As shown in FIGS. 9 and 10, the pipe 36 having the holes 37 can be disposed parallel to the traction member 33 instead of traction member 33 being connected to an end of pipe 33 as in FIGS. 7 and 8. In this manner, the traction member 33 is separate from the pipe 36 and can extend throughout the length of the duct 10B. In this manner, the traction member 33 (which is labeled 32 for the left section) can be pulled in both the right direction using member 33 and the left direction using member 33, as in the embodiment of FIG. 5 etc.

Figure 11:
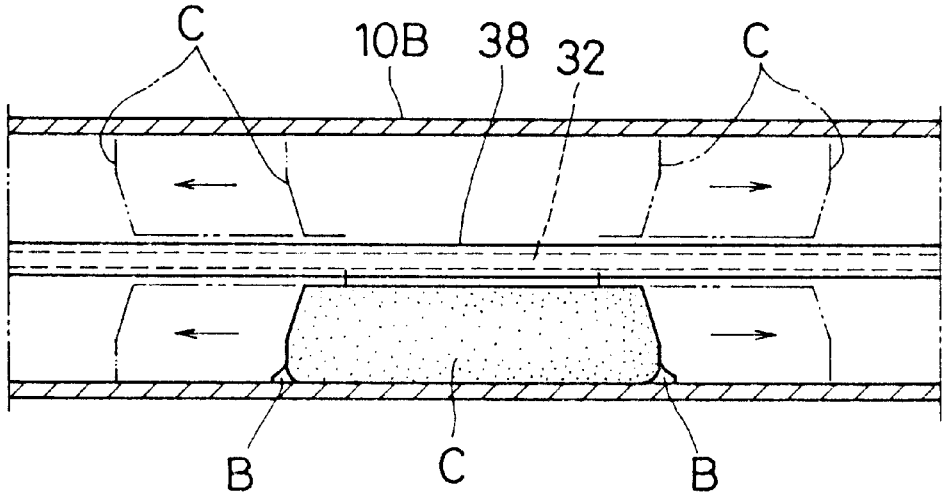
FIG. 11 is a sectional view depicting another embodiment of the invention.
Figure 12:
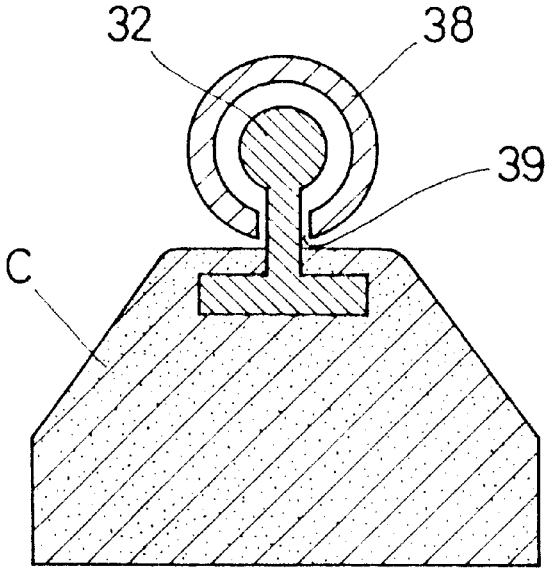
FIG. 12 is a sectional view depicting the mounted state of the cleaning and wiping elements.

A sixth embodiment is shown in FIGS. 11 and 12 and is designed to remove dirt deposits from the inside of ducts 10A,10B using a sector shaped or trapezoidal shaped cleaning and wiping element C which is attached to a traction member 32 through "T" shaped connecting piece 39 (see FIG. 12). The traction member 32, is disposed movably inside a circular shaped guide 38, and is movable to the left and right inside of duct 10B by use of hand power or mechanical power. The cleaning and wiping element(s) C can also be disposed around the other side of guide 38. The element(s) C is impregnated with cleaning solvent B and used in the same manner as the prior embodiments to remove and clean deposits from the inner surfaces of the duct 10B. Also, the solvent may be supplied separately.

The use of the guide 38 prevents any damage from occurring on the inside of duct 10B through movement of the traction member 33 therein. Also, advantageously, with this embodiment, wiping position is not dislocated.

Figure 13:
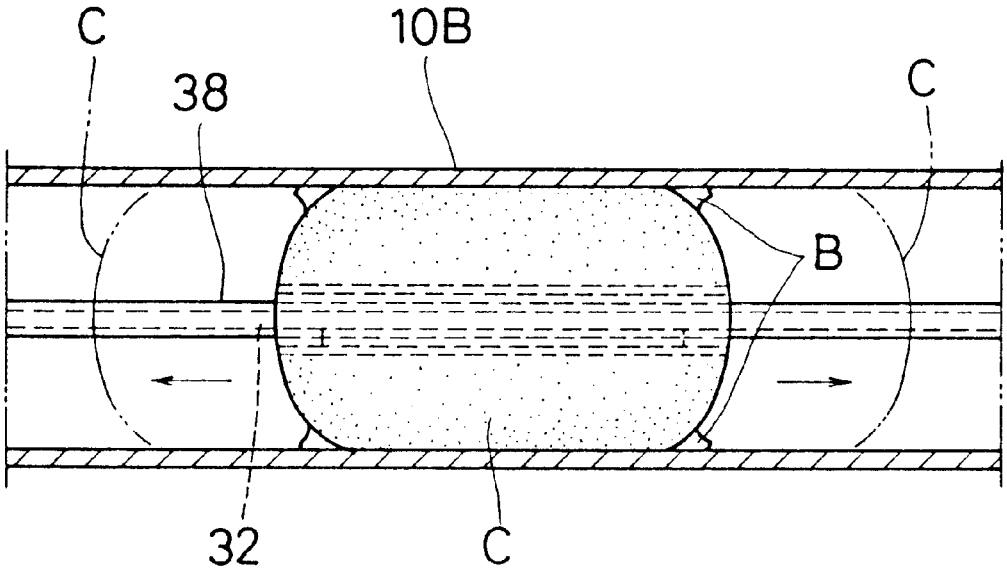
FIG. 13 is a sectional view depicting a cleaning method using tubular cleaning and wiping elements.
Figure 14:
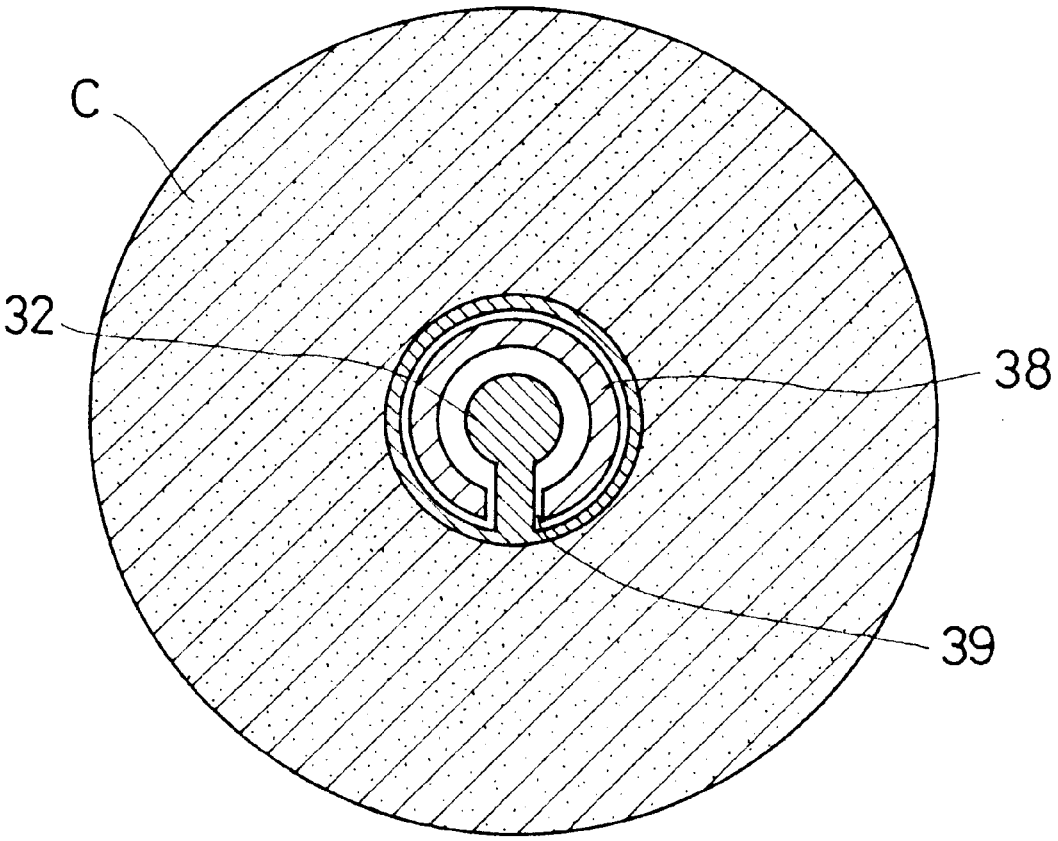
FIG. 14 is a sectional view depicting the mounted state of the tubular cleaning and wiping elements.

The traction member 32 can also be placed inside a guide 38 which is disposed in the center of the cleaning and wiping element(s) C, as shown in FIGS. 13 and 14. In FIGS. 13 and 14, traction member 32 is inserted into wire guide 38 and is connected to element C through a connecting piece 39. The member 32 is movable within the wire guide 38, as in the embodiment of FIGS. 11 and 12. In this manner, the entire inner peripheral surface of the duct 10B will be in contact with the element C and be cleaned thereby. Thus, cleaning efficiency and effectiveness is improved. Also, the advantage of the embodiment of FIGS. 11 and 12, namely, that no moving wire is exposed to injure the inside of duct 10B, is achieved in this embodiment, in addition to the cleaning of the entire peripheral surface of the duct, are achieved by this embodiment.

The invention and embodiments discussed above correspond as follows. The air intake passages of the invention correspond to ducts 10A,10B, 10C of the embodiments. The supply means corresponds to the blowing fan 17 and solvent source 18. The moving means corresponds to fan 5 and traction member 31. The air supplying means corresponds to fan 5. The traction member corresponds to the traction member 31, 32, 33 and 36.

However, the invention is not limited to the disclosed embodiments. For example, in FIGS. 1,3,4 and 5, the object of the cleaning is an air conditioner of a central air conditioning system, but it may also be applied to other types of systems. Alternatively, mesh members may be disposed inside of the seal member 19, and soap water may be supplied from solvent line 23 which is foamy, or depending on the structure, since ducts 10A and 10B may be disposed higher than the heat exchanger 6 and lift may be needed.

What is claimed is:

1. A cleaning apparatus for use in cleaning the inside walls of a passage through which air travels to or from a heat exchanger and having a plurality of ports, said apparatus comprising:

means for closing in a leak proof manner all of said plurality of ports except at least one port;

means for supplying a cleaning solvent into said passage through said at least one port; and means for supplying air flow under positive pressure into said passage through said at least one port and concurrently with the supplying of said cleaning solvent, whereby said cleaning solvent is caused to be in contact with the inside walls of said passage by force of said air flow under positive pressure so that any deposit on said inside walls is contacted by said cleaning solvent and caused to become loosened and removed therefrom by the air flow under positive pressure.

2. The apparatus of claim 1, wherein said at least one port is located furthest from said heat exchanger.

3. The apparatus of claim 1, wherein said cleaning solvent is also made to contact said heat exchanger thereby to effect cleaning thereof.

4. A method of cleaning the inside walls of a passage through which air travels to or from a heat exchanger and having a plurality of ports, said method comprising the steps of:

closing in a leak proof manner all of said plurality of ports except at least one port;

supplying a cleaning solvent into said passage through said at least one port; and supplying air flow under positive pressure into said passage through said at least one port and concurrently with the supplying of said cleaning solvent;

whereby said cleaning solvent is caused to be in contact with the inside walls of said passage by force of said air flow under positive pressure so that any deposit on said inside walls is contacted by said cleaning solvent and caused to become loosened and removed therefrom by the air flow under positive pressure.

5. The method of claim 4, wherein said at least one port is located furthest from said heat exchanger.

6. the method of claim 4, wherein said cleaning solvent is also made to contact said heat exchanger thereby to effect cleaning thereof.

* * * * *